US006477952B1

(12) United States Patent
Izume

(10) Patent No.: US 6,477,952 B1
(45) Date of Patent: Nov. 12, 2002

(54) INK FEED ROLLER FOR PRINTERS

(75) Inventor: Masayuki Izume, Kyoto (JP)

(73) Assignee: I. Mar Planning, Inc., Kyoto (JP)

( * ) Notice: Subject to any disclaimer, the term of this patent is extended or adjusted under 35 U.S.C. 154(b) by 0 days.

(21) Appl. No.: 09/647,096

(22) PCT Filed: Mar. 30, 1998

(86) PCT No.: PCT/JP98/01421

§ 371 (c)(1),
(2), (4) Date: Sep. 26, 2000

(87) PCT Pub. No.: WO99/50071

PCT Pub. Date: Oct. 7, 1999

(51) Int. Cl.[7] ..... B41F 31/00; B25F 5/02
(52) U.S. Cl. ..... 101/352.11; 492/28; 492/53
(58) Field of Search ..... 101/348, 352.11, 101/375; 492/28, 47, 49, 50, 53, 56; 428/422

(56) References Cited

U.S. PATENT DOCUMENTS

| | | | | | |
|---|---|---|---|---|---|
| 3,292,535 | A | * | 12/1966 | Cutler | 101/351.7 |
| 3,635,158 | A | * | 1/1972 | Budinger | 101/348 |
| 3,941,635 | A | * | 3/1976 | Tavelle et al. | 492/49 |
| 4,024,816 | A | * | 5/1977 | Williams et al. | 101/329 |
| 4,287,827 | A | * | 9/1981 | Warner | 101/352.11 |
| 4,313,981 | A | * | 2/1982 | Wamiki | 492/56 |
| 4,317,270 | A | * | 3/1982 | Watanabe et al. | 492/50 |
| 5,123,151 | A | * | 6/1992 | Wehara et al. | 492/56 |
| 5,546,173 | A | * | 8/1996 | Hinotani et al. | 492/28 |
| 5,583,600 | A | * | 12/1996 | Kurusawa | 492/28 |
| 5,609,534 | A | * | 3/1997 | Hayashi et al. | 492/53 |
| 5,794,091 | A | * | 8/1998 | Verlinden et al. | 492/28 |
| 5,798,181 | A | * | 8/1998 | Hobson et al. | 428/422 |
| 5,957,052 | A | * | 9/1999 | Endish | 101/375 |
| 6,011,946 | A | * | 1/2000 | Eddy et al. | 492/53 |

FOREIGN PATENT DOCUMENTS

| | | |
|---|---|---|
| DE | 195 03 275 | 8/1996 |
| JP | 60-38160 A | 2/1985 |
| JP | 1-139297 | 5/1989 |

* cited by examiner

*Primary Examiner*—Eugene H. Eickholt
(74) *Attorney, Agent, or Firm*—Armstrong, Westerman & Hattori, LLP

(57) ABSTRACT

An object of the invention is to prevent ink becoming mixed with paper particles from adhering to and accumulating on edge portions of an inking roller for use in printing presses. The inking roller 5 is coated with a nonadhesive agent, which prevents ink or the like becoming mixed with paper particles from adhering, over an edge portion 5*a* between an outer peripheral surface of the roller and each of end faces thereof, an end portion of the outer peripheral surface continuous with the edge portion 5*a* and at least a portion of the end face toward the outer peripheral surface, and is thereby formed with a nonadhesive layer 27.

3 Claims, 3 Drawing Sheets

INK FEED ROLLER FOR PRINTERS

TECHNICAL FIELD

The present invention relates to inking rollers for use in printing presses, and more particularly to rollers, such as vibrating rollers and distributing rollers, for use in offset presses, letterpress printing machines, etc. for supplying ink from the ink fountain to the printing portion.

BACKGROUND ART

For example in offset presses, ink is supplied from an ink fountain to the printing portion between a blanket cylinder and an impression cylinder by way of a fountain roller, vibrating roller, a plurality of distributing rollers, form roller, plate cylinder and the blanket cylinder. The ink transferred to the blank cylinder is further transferred onto paper, which is the material to be printed on, passed through the printing portion.

The blanket cylinder having the ink applied to the required areas of its outer peripheral surface is pressed against the surface of the paper at the printing portion, so that paper particles on the paper surface adhere to the ink remaining on the surface of the blanket cylinder. The ink portion becoming mixed with the paper particles is transferred to the plate cylinder, form roller, distributing rollers and vibrating roller in succession in a direction opposite to the direction of supply of the ink. Consequently, the ink incorporating paper particles lodges and accumulates especially on the edge portion between the outer periphery of each of the vibrating roller and the distributing rollers and each end face thereof. The deposit of the ink gradually becomes protuberant and hard, so that there arises a need to remove the deposit every day before the printing operation. This work is cumbersome and requires time and labor. In the case where the press has many distributing rollers, the ink removing work is very troublesome.

Proposed in recent years are printing presses which comprise a plurality of vibrating rollers positioned between the fountain roller and the first distributing roller, divided axially of these rollers and arranged at an interval axially thereof so that the quantity of ink to be supplied to the printing portion can be adjusted at positions along the widthwise direction of the paper. Such a press has a large number of vibrating rollers each permitting the ink to lodge and accumulate on opposite end edge portions thereof. The removal of the ink deposit therefore requires very troublesome work. The same problem is encountered also with other types of printing presses such as letterpress printing machines.

An object of the present invention is to overcome the foregoing problem and to provide an inking roller for use in printing presses which is adapted to prevent ink becoming mixed with paper particles from adhering to and accumulating on the edge portions thereof.

DISCLOSURE OF THE INVENTION

The present invention provides a roller characterized in that a nonadhesive layer, which prevents ink or the like becoming mixed with paper particles from adhering, is formed on the roller over an edge portion between an outer peripheral surface of the roller and each of end faces thereof, an end portion of the outer peripheral surface continuous with the edge portion and at least a portion of the end face toward the outer peripheral surface.

Nonadhesiveness is a property of preventing ink or the like becoming mixed with paper particles from adhering. The nonadhesive layer comprises a nonadhesive resin such as tetrafluoroethylene resin or like fluorocarbon resin or silicone resin.

The nonadhesive layer may be formed by adhering to the roller a member at least having a surface formed from a nonadhesive agent and covering the edge portion between the roller outer peripheral surface and each end face thereof, the end portion of the outer peripheral surface continuous with the edge portion and at least the portion of the end face toward the outer peripheral surface, whereas it is especially desirable to form the layer by coating the roller with a nonadhesive agent.

Ink or the like has difficulty in adhering to the nonadhesive layer which is formed on the roller over the edge portion, the outer peripheral surface portion continuous therewith and the end face. It is therefore unlikely that the ink or the like becoming mixed with paper particles will adhere to and accumulate on the roller edge portion.

Thus, the present invention prevents the ink or the like becoming mixed with paper particles from adhering to and accumulating on the edge portion, obviating the need to perform cumbersome ink removing work before printing operation.

The width (axial width) of the nonadhesive layer on the roller outer peripheral surface and the width (radial width) of the layer on the end face are suitably determined from such a range that the paper particle-incorporating ink or the like can be prevented from lodging and accumulating on the edge portion. If too small in these widths, the nonadhesive layer will be ineffective for preventing adhesion and accumulation of the ink, while the effect to prevent adhesion and accumulation of the ink or the like remains the same even if the widths increase beyond a certain value. Accordingly, it is desirable to minimize the widths insofar as the adhesion and accumulation of the ink or the like can be precluded. The layer will not cause any particular trouble even if having a large width on the end face, whereas an excessively large width on the outer peripheral surface is not desirable. Although the minimum width required for preventing the adhesion and accumulation of the ink or the like varies with other conditions such as the size of the roller, the width on the outer peripheral surface is suitably determined, for example, from the range of 0.5 to several millimeters in view of such conditions.

The thickness of the nonadhesive layer, which is preferably smaller, is several micrometers to about 100 micrometers to be satisfactory.

BEST MODE OF CARRYING OUT THE INVENTION

Embodiments of the present invention will be described below with reference to the drawings.

Figure 1:
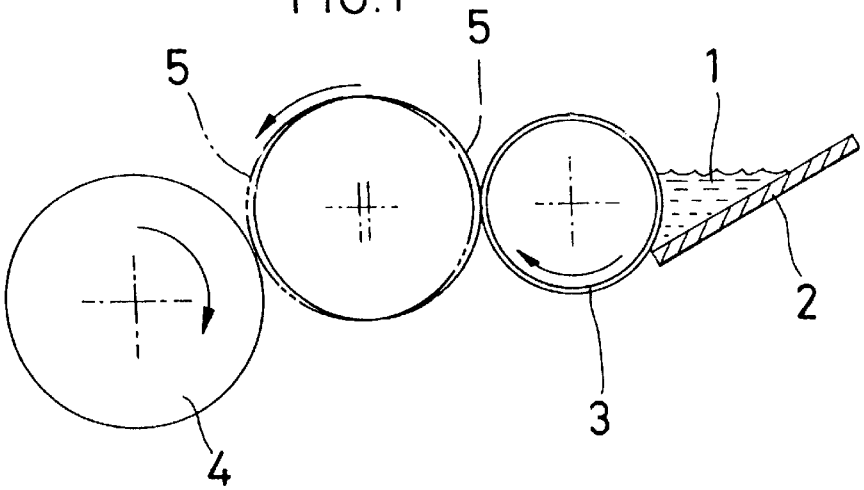
FIG. 1 is a schematic side elevation of the inking arrangement of a printing press embodying the invention.
Figure 3:
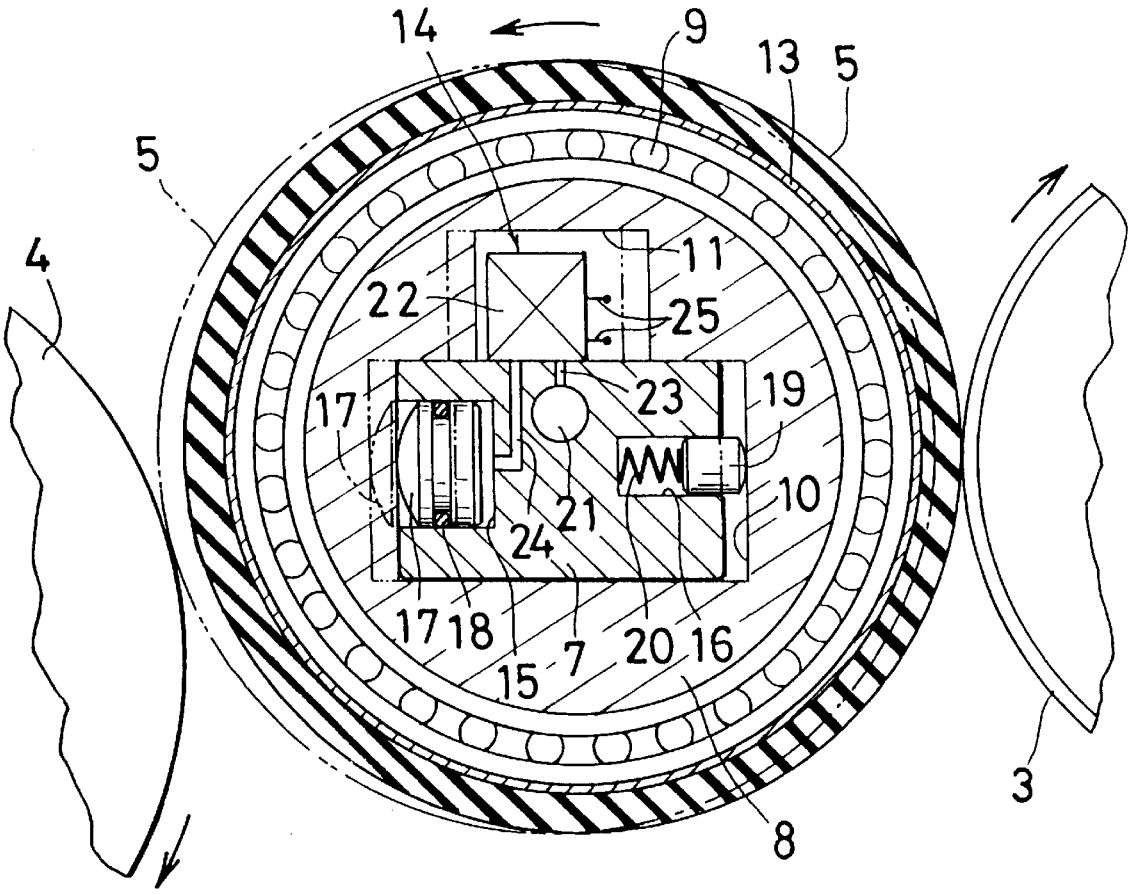
FIG. 3 is an enlarged view in section taken along the line III—III in FIG. 2.
Figure 2:
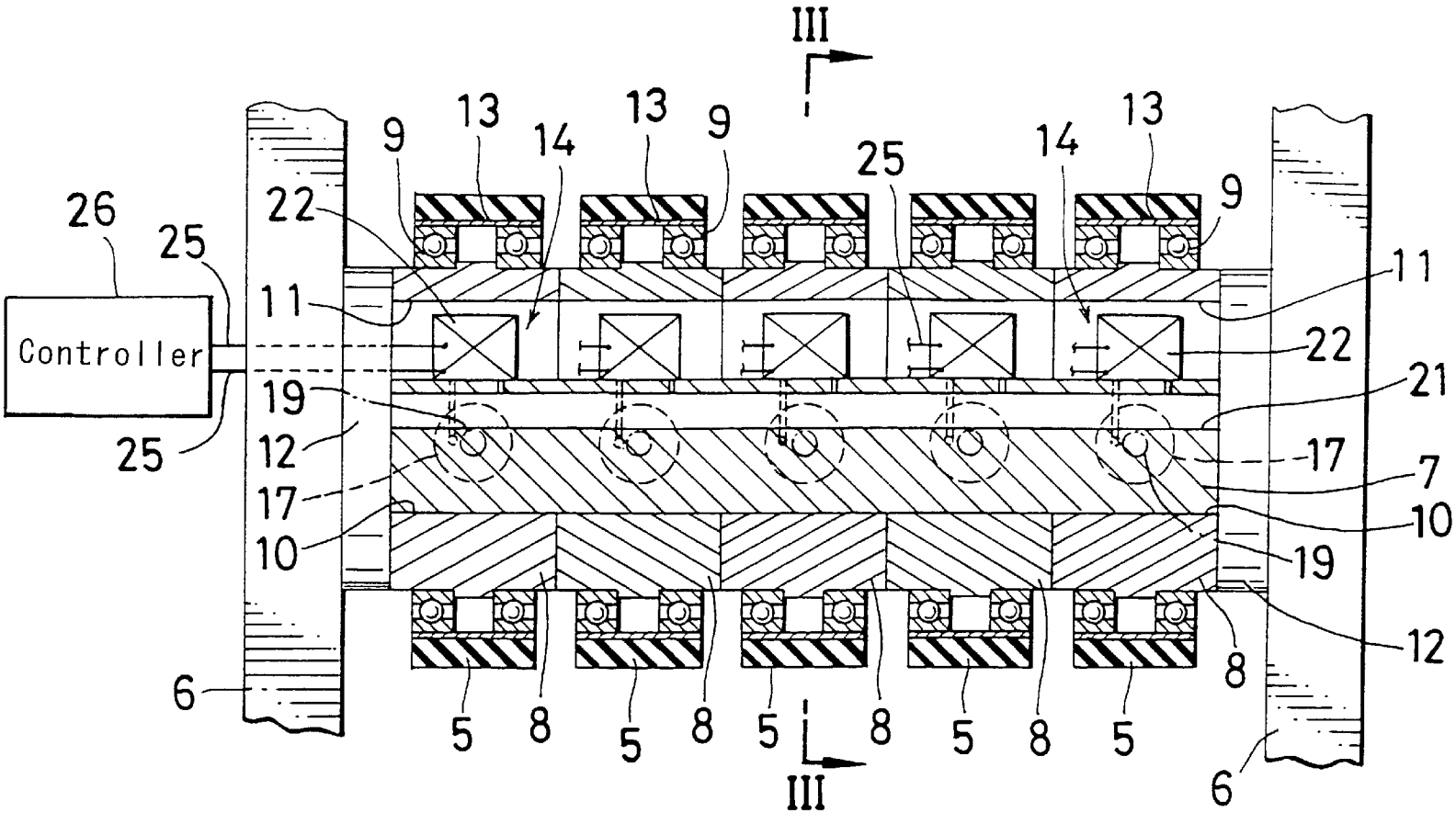
FIG. 2 is a view in longitudinal section showing a plurality of vibrating rollers on an enlarged scale.

FIG. 1 schematically shows part of the inking arrangement of a printing press, and FIGS. 2 and 3 show the main portion of the same on enlarged scales. In the following description, the right-hand side of FIGS. 1 and 3 will be referred to as the "front," the left-hand side thereof as the "rear," and the terms "left" and "right" refer to the left and the right of the arrangement as it is seen from the front rearward, i.e., to the left-hand side and the right-hand side of FIG. 2.

The arrangement has an ink quantity adjusting plate (doctor blade) 2 providing the bottom of an ink fountain 1, a fountain roller 3 proximate to the plate 2, and the first 4 of a plurality of distributing rollers to the rear of the fountain roller 3. Between the fountain roller 3 and the distributing roller 4, a plurality of vibrating rollers 5 divided axially of these rollers 3, 4 are arranged at an interval in the axial direction. The fountain roller 3 and the distributing roller 4 are rotatably supported by the frame 6 of the press so as to be parallel to each other and are rotated by an unillustrated drive device in the respective directions of arrows in FIGS. 1 and 3 at predetermined speeds as timed with each other.

The vibrating rollers 5 are provided around a support member 7 fixed to the frame 6, each by a movable member 8 and ball bearings 9, so as to be parallel to the fountain roller 3 and the distributing roller 4. The support member 7 is in the form of a prism having a front-to-rear width greater than the vertical width thereof and has its opposite ends secured to the frame 6. The movable member 8 is in the form of a short cylinder and has a rectangular bore 10 axially extending therethrough in its center portion. The upper wall of the bored portion 10 is formed with a groove 11 extending over the entire length of the movable member 8. The movable members 8 are arranged in the axial direction without any intervening clearance between a pair of positioning members 12 each in the form of a disk and secured to the frame 6. The support members 7 extend through the bores of the movable members 8. The vertical width of the bore 10 of the movable member 8 is approximately equal to the vertical width of the support member 7, and the upper and lower surfaces defining the bore 10 are slidable in contact with the respective upper and lower surfaces of the support member 7. The front-to-rear width of the bore 10 is slightly greater than the front-to-rear width of the support member 7. The movable member 8 is movable forward and rearward between a front limit position wherein the rear surface of the bored portion 10 is in contact with the rear surface of the support member 7 and a rear limit position wherein the front surface of the bored portion 10 is in contact with the front surface of the support member 7. The end face of each movable member 8 is merely slidable in contact with the end face of another movable member 8 or the end face of the positioning member 12 adjacent thereto, such that the movable members 8 are individually movable forward and rearward. The inner rings of two bearings 9 are fixed to the outer periphery of each movable member 8, and the vibrating roller 5 in the form of a rubber cylinder of large wall thickness is fixedly fitted around a metal sleeve 13 secured to the outer rings of these bearings 9.

A change-over device 14 for the vibrating roller 5 is provided between each movable member 8 and the support member 7 in the following manner, as mounted on the support member 7. The portion of the support member 7 corresponding to the midportion of the movable member 8 with respect to the axial direction is formed with a cylinder portion 15 extending from the rear surface forward a short distance, and a spring cavity 16 extending from the front surface rearward a short distance. A piston 17 is inserted in the cylinder portion 13 forwardly and rearwardly slidably, with an O-ring 18 fitted therein around the piston. Inserted in the spring cavity 16 are a biasing pin 19 slidable forward and rearward, and a compression coil spring 20 for biasing the pin forward. The support member 7 has an air supply channel 21 extending axially therethrough and having one end in communication with an unillustrated compressed air source. A solenoid valve 22 is mounted on the upper surface of the support member 7 facing the groove 11 of the movable member 8. Two ports of the valve 22 in the groove 11 communicate respectively with the air supply channel 21 and the cylinder portion 15 through communication passageways 23, 24 formed in the support member 7. Electric wires 25 of the valve 22 extend through the groove 11 to the outside and are connected to a control circuit 26. The cylinder portion 15 communicates with the air supply channel 21 through the valve 22 when the valve 22 is energized (on state), and is caused to communicate with the atmosphere through the valve 22 when the valve 22 is unenergized (off state).

When the energization state of the valve 22 of the change-over device 14 is changed by the control circuit 26, the vibrating roller 5 is brought to a first position in which the roller 5 is in contact with the fountain roller 3 and away from the distributing roller 4, or alternatively to a second position in which the roller 5 is in contact with the distributing roller 4 and away from the fountain roller 3. When the valve 22 is turned off, the cylinder portion 15 is caused to communicate with the atmosphere, rendering the piston 17 free to move in the cylinder portion 15. Accordingly, the movable member 8 is moved forward by the spring 20 and the pin 19 as indicated in solid lines in FIG. 3, with the result that the vibrating roller 5 is brought to the first position into pressing contact with the fountain roller 3. The vibrating roller 5 is rotated in the direction of arrow of FIG. 3 by the frictional force of the fountain roller 3. When the valve 22 is turned on, the cylinder portion 15 is caused to communicate with the air supply channel 21, whereby compressed air is supplied to the cylinder portion 15. The piston 17 is therefore projected rearward from the support member 17 against the force of the spring 20 as indicated in chain lines in FIG. 3, moving the movable member 8 rearward. Consequently, the vibrating roller 5 is alternatively brought to the second position into pressing contact with the distributing roller 4. The vibrating roller 5 is rotated in the direction of arrow of FIG. 3 by the frictional force of the distributing roller 4.

Ink is brought out of the ink fountain 1 through a clearance between the fountain roller 3 and the adjusting plate 2 onto the surface of the roller. At this time, the thickness of film of the ink, i.e. the quantity of the ink, egressing to the surface of the fountain roller 3 is controllable by adjusting the clearance between the roller 3 and the plate 2. The ink brought to the surface of the fountain roller 3 is transferred to the vibrating roller 5 while the roller 5 is in the first position, and the ink transferred to the roller 5 is transferred to the distributing roller 4 while the roller 5 is alternatively in the second position. The ink transferred to the distributing roller 4 is supplied to the printing portion via other distributing rollers, form roller and plate cylinder and transferred onto paper passed through the printing portion. The lengths of time during which each vibrating roller 5 is held in the first position and the second position are controlled by the control circuit 26, whereby the quantity of ink to be supplied to the printing portion is adjusted from position to position widthwise of the paper.

With the inking arrangement described, the-space for the installation of the vibrating roller 5 can be small since the change-over device 14 for the vibrating roller 5 is provided on the support member 7 between the movable member 8 and the support member 7. The change-over device 14 is adapted to pneumatically shift the movable m ember 8 using the piston 17. This results in a smaller rise in the temperature of the change-over device 14 than when an electromagnet is used, making it possible to render the change-over device 14 simplified in construction and compact. The electric wires 25 are connected to the valve 22 mounted on the upper side of the support member 7 and exposed within the groove 11 of the movable member 8 and are merely caused to extend through the groove 11 to the outside, hence simplified wiring for the valve 22 and an easy wiring procedure. The change-over device 14 is simple in construction and compacted also because the cylinder portion 15 having the piston 17 inserted therein and the cavity 16 accommodating the biasing pin 19 and the spring 20 are formed directly in the support member 7. Furthermore, the air passage communicating with the valve 22 and comprising the air supply channel 21 and the communication passageways 23, 24 is formed directly in the support member 7. This obviates the need for piping for the valve 22 and a space for the piping, serving to make the change-over device simple in construction and compact correspondingly.

Figure 4:
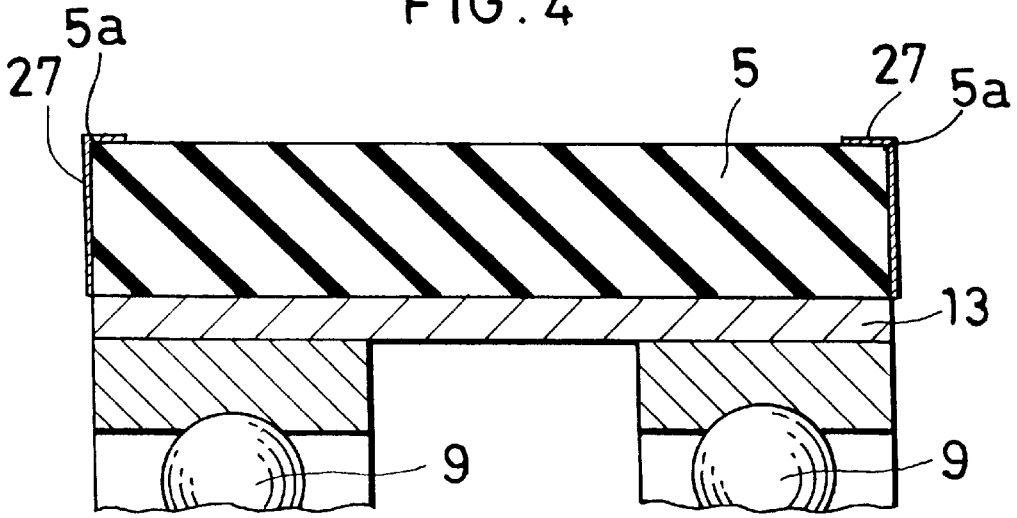
FIG. 4 is a fragmentary view in vertical section showing one of the vibrating rollers of FIG. 2 on an enlarged scale.

FIG. 4 shows part of the vibrating roller 5 on an enlarged scale. Each of opposite end portions of each vibrating roller 5 is coated, over the edge portion 5*a* between the roller outer peripheral surface and the end face, an end portion of the outer peripheral surface continuous with the edge portion and the end face with a nonadhesive agent comprising a nonadhesive resin such as tetrafluoroethylene resin or like fluorocarbon resin or silicone resin and thereby formed with a nonadhesive layer 27 which prevents ink or the like becoming mixed with paper particles from adhering . The nonadhesive layer 27 is, for example, several tens of micrometers in thickness. The portion of the layer 27 on the outer peripheral surface has an axial width, for example, of 0.5 to several millimeters. The drawing shows the thickness of the nonadhesive layer 27 as especially exaggerated.

Figure 5:
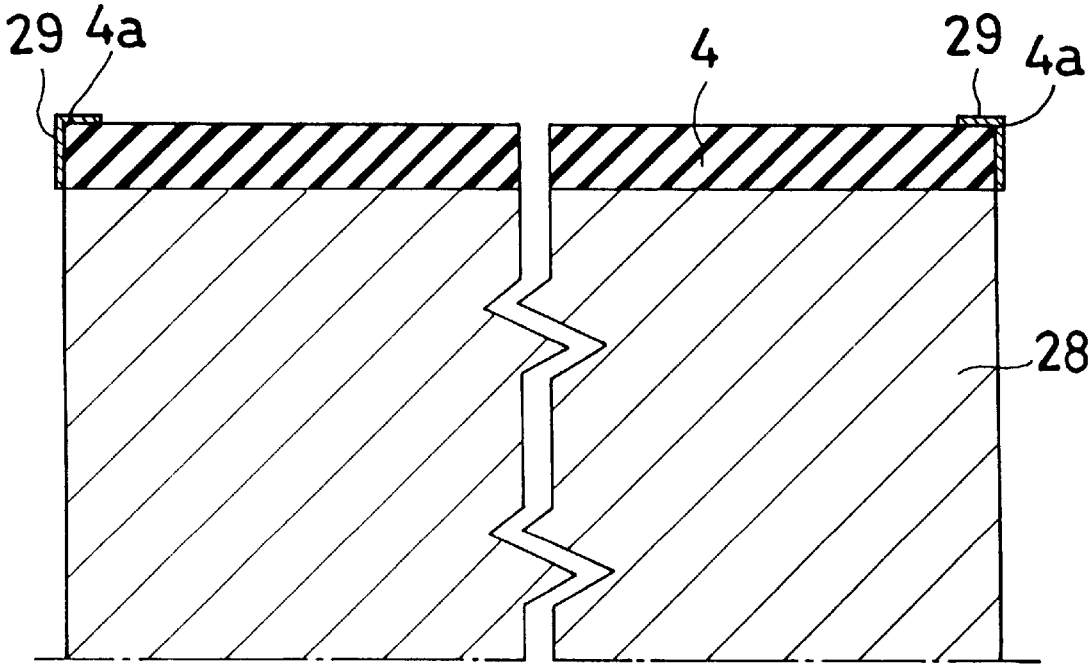
FIG. 5 is a view in longitudinal section showing opposite end portions of a distributing roller on an enlarged scale.

FIG. 5 shows opposite end portions of the distributing roller 4 on an enlarged scale. The distributing roller 4 is in the form of a rubber cylinder having a large wall thickness and fixedly fitted around a metal core 28. A nonadhesive agent is applied by coating to each of opposite end portions of the distributing roller 4 over the edge portion 4*a* between the roller outer peripheral surface and the end face, an end portion of the outer peripheral surface continuous with the edge portion and the end face to thereby form a nonadhesive layer 29, which prevents ink or the like becoming mixed with paper particles from adhering, like the above layer. Like layers are formed also on the other distributing rollers not shown.

Since the nonadhesive layer 27 or 29, which prevents ink or the like becoming mixed with paper particles from adhering, is formed on each of the vibrating roller 5 and the distributing roller 4 on the edge portion 5*a* or 4*a* at each end thereof, the outer peripheral portion continuous with the edge portion and the end face, the ink containing paper particles is unlikely to adhere to and accumulate on the edge portion 5*a* or 4*a* even if sent forward from the printing portion.

Although the cylindrical vibrating roller 5 and distributing roller 4 are each formed with the nonadhesive layer 27 or 29 over the entire radial width of each end face according to the embodiments described, the layer may be formed on the end face over only a portion thereof toward the outer periphery and given, for example, approximately the same width as on the outer peripheral surface.

The components of the inking arrangement are not limited to those of the foregoing embodiments in construction but can be modified suitably. According to the embodiments, the vibrating roller 5 is shiftable to a position where the roller 5 is in contact with the fountain roller 3 and away from the distributing roller 4 or alternatively to a position where the roller 5 is in contact with the distributing roller 4 and away from the fountain roller 3, whereas as disclosed, for example, in JP-A No. 301439/1990, the vibrating roller as held in contact with the distributing roller at all times may be shifted to a position in contact with the fountain roller or alternatively to a position away from the fountain roller. Although the foregoing embodiment comprises a plurality of vibrating rollers 5 which are divided axially of the fountain roller 3, one integral vibrating roller may be provided which has approximately the same length as the fountain roller 3.

The invention is applicable not only to the vibrating rollers 5 and the distributing roller 4 but also to other inking rollers.

Although the nonadhesive layers 27, 29 are formed on the vibrating roller 5 or the distributing roller 4 by coating according to the embodiment, the nonadhesive layer may be formed by other means. For example, each end portion of the roller 5 may be covered with a covering member adhered thereto and comprising a short tubular portion to be provided around the roller end portion and an inner flange integral with one end of the tubular portion, at least the surface of the covering member being formed from a nonadhesive resin such as tetrafluoroethylene resin or like fluorocarbon resin or silicone resin.

INDUSTRIAL APPLICABILITY

The invention is applicable to inking rollers of printing presses, more specifically to vibrating rollers and distributing rollers for use in offset presses, letterpress machines, etc. for supplying ink from the ink fountain to the printing portion.

What is claimed is:

1. An inking roller for use in printing presses which is characterized in that a nonadhesive layer, which prevents ink or the like becoming mixed with paper particles from adhering, is formed on the roller over an edge portion between an outer peripheral surface of the roller and each of end faces thereof, an end portion of the outer peripheral surface continuous with the edge portion and at least a portion of the end face toward the outer peripheral surface.

2. An inking roller for use in printing presses according to claim 1 which is characterized in that the nonadhesive layer is formed by coating the roller with a nonadhesive agent.

3. An inking roller for use in printing presses according to claim 1 or 2 which is characterized in that the nonadhesive layer comprises a nonadhesive resin.

* * * * *